US008282022B2

(12) United States Patent
Porter

(10) Patent No.: US 8,282,022 B2
(45) Date of Patent: Oct. 9, 2012

(54) ROTARY STREAM SPRINKLER NOZZLE WITH OFFSET FLUTES

(75) Inventor: LaMonte D. Porter, San Marcos, CA (US)

(73) Assignee: Hunter Industries, Inc., San Marcos, CA (US)

( * ) Notice: Subject to any disclaimer, the term of this patent is extended or adjusted under 35 U.S.C. 154(b) by 542 days.

(21) Appl. No.: 11/928,579

(22) Filed: Oct. 30, 2007

(65) Prior Publication Data

US 2009/0108099 A1 Apr. 30, 2009

(51) Int. Cl.
*B05B 3/02* (2006.01)

(52) U.S. Cl. ..... 239/222.11; 239/222.13; 239/222.17; 239/203; 239/204; 239/240; 239/232; 239/233

(58) Field of Classification Search ..... 239/208, 239/203, 204, 206, 205, 207, 240, 237, 233, 239/232, 242, 222.11, 222.13, 222.17
See application file for complete search history.

(56) References Cited

U.S. PATENT DOCUMENTS

| | | | | | |
|---|---|---|---|---|---|
| 1,331,255 | A | * | 2/1920 | Gruenberg | 239/222.19 |
| 1,764,570 | A | | 6/1930 | Lohman | |
| 2,493,595 | A | | 1/1950 | Rieger | 299/126 |
| 2,595,114 | A | * | 4/1952 | Wieseltier | 239/97 |
| 3,111,268 | A | * | 11/1963 | Butler | 239/170 |
| 3,131,867 | A | * | 5/1964 | Miller et al. | 239/97 |
| 3,854,664 | A | | 12/1974 | Hunter | 239/206 |
| 3,888,417 | A | * | 6/1975 | Harmon | 239/97 |
| 4,272,024 | A | * | 6/1981 | Kah, Jr. | 239/206 |
| 4,353,506 | A | | 10/1982 | Hayes | 239/206 |
| 4,471,908 | A | * | 9/1984 | Hunter | 239/11 |
| 4,815,662 | A | | 3/1989 | Hunter | 239/222 |
| 4,842,201 | A | | 6/1989 | Hunter | 239/396 |
| 4,867,379 | A | | 9/1989 | Hunter | 239/240 |
| 4,898,332 | A | | 2/1990 | Hunter et al. | 239/240 |
| 4,932,590 | A | | 6/1990 | Hunter | 239/222 |
| 4,967,961 | A | * | 11/1990 | Hunter | 239/240 |
| 4,971,250 | A | * | 11/1990 | Hunter | 239/222.17 |
| 5,058,806 | A | | 10/1991 | Rupar | 239/205 |
| 5,288,022 | A | | 2/1994 | Sesser | 239/205 |
| 5,372,307 | A | * | 12/1994 | Sesser | 239/210 |
| 5,718,381 | A | * | 2/1998 | Katzer et al. | 239/222.11 |
| 5,761,886 | A | * | 6/1998 | Parkhideh | 53/454 |
| 6,244,521 | B1 | | 6/2001 | Sesser | 239/222.17 |
| 6,499,672 | B1 | | 12/2002 | Sesser | 239/222.11 |
| 6,651,904 | B2 | * | 11/2003 | Roman | 239/204 |
| 6,651,905 | B2 | * | 11/2003 | Sesser et al. | 239/205 |
| 6,688,539 | B2 | | 2/2004 | Griend | 239/222.11 |

(Continued)

*Primary Examiner* — Len Tran
*Assistant Examiner* — Trevor E McGraw
(74) *Attorney, Agent, or Firm* — Michael H. Jester

(57) ABSTRACT

A sprinkler nozzle includes a nozzle plate having at least one orifice formed therein. A stream deflector is rotatably mounted adjacent the nozzle plate and has a plurality of flutes formed therein that face the nozzle plate. Each flute has an inner portion that can momentarily align with water flowing through the orifice in the nozzle plate during rotation of the stream deflector relative to the nozzle plate. Water flowing through the orifice will be channeled in a generally radial direction by the flute to form a stream of water that is ejected from the stream deflector. The flutes have a plurality of different tangential trajectories relative to the orifice in the nozzle plate so that in combination the streams of water successively ejected from the stream deflector establish a predetermined shape of coverage.

14 Claims, 11 Drawing Sheets

U.S. PATENT DOCUMENTS

| | | | | |
|---|---|---|---|---|
| 6,736,332 | B2 | 5/2004 | Sesser et al. | 239/204 |
| 6,814,304 | B2 | 11/2004 | Onofrio | 239/201 |
| 7,032,836 | B2 | 4/2006 | Sesser et al. | 239/204 |
| D527,791 | S | 9/2006 | Onofrio et al. | D23/214 |
| 7,100,842 | B2 * | 9/2006 | Meyer et al. | 239/214 |
| 7,143,957 | B2 * | 12/2006 | Nelson | 239/222.21 |
| 7,159,795 | B2 | 1/2007 | Sesser et al. | 239/203 |
| 7,255,291 | B1 * | 8/2007 | Lo | 239/242 |
| 2004/0262426 | A1 | 12/2004 | Antonucci et al. | 239/233 |
| 2007/0029414 | A1 * | 2/2007 | Tilton et al. | 239/589 |
| 2008/0230628 | A1 * | 9/2008 | Alexander | 239/205 |
| 2008/0277489 | A1 * | 11/2008 | Townsend | 239/7 |

* cited by examiner

ROTARY STREAM SPRINKLER NOZZLE WITH OFFSET FLUTES

FIELD OF THE INVENTION

The present invention relates to sprinklers used to irrigate turf and landscaping, and more particularly, to rotary stream irrigation sprinklers that eject relatively small individuals streams of water.

BACKGROUND OF THE INVENTION

Many geographic locations have insufficient rainfall or dry spells that require turf and landscaping to be watered to maintain the proper health of the vegetation. Turf and landscaping are often watered utilizing an automatic irrigation system that includes a programmable controller that turns a plurality of valves ON and OFF to supply water through underground pipes connected to sprinklers. Golf courses, playing fields and other large areas typically require rotor-type sprinklers that eject a long stream of water via a single relatively large nozzle that oscillates through an adjustable arc. Smaller areas are often watered with spray heads or rotary stream sprinklers. Spray heads eject a fan-shaped pattern of water at a relatively high rate and much of this water often flows off the vegetation and/or blows away and is wasted. Rotary stream sprinklers eject relatively small individual streams of water and use less water than spray head sprinklers. In some cases drip nozzles are employed in residential and commercial irrigation systems for watering trees and shrubs, for example.

Rotary stream sprinklers sometimes incorporate a turbine and gear train reduction for slowly rotating the nozzle head or stream deflector. The turbine is typically located at the bottom of the sprinkler, below the gear box that holds the gear train reduction, and above the stator where one is employed. A rotary stream sprinkler can also use the water to directly power the stream deflector, in which case the flutes formed on the underside of the stream deflector that form and channel the streams of water are angled so that a rotational force on the stream deflector is generated. Where the water directly provides the rotary force to the stream deflector, a brake or damper is employed to slow the rate of rotation of the stream deflector.

FIG. 1 illustrates a stream deflector 2 of a conventional rotary stream sprinkler. The inner end of each of the flutes 4 terminates adjacent, and is aligned with, the rotational axis 6 of the stream deflector 2. Rotary stream sprinklers typically include a nozzle plate 8 (FIG. 2) with a suitably shaped orifice 10 that directs water onto the underside of the stream deflector 2 so that the streams only fall onto the desired shape of coverage, e.g. a ninety degree arc in the example shown. In another conventional rotary stream sprinkler the nozzle plate 12 (FIG. 3) has a cylindrical configuration with multiple orifices 14, 16 and 18 that are either open, have varying degrees of restriction, or are plugged. In yet another conventional rotary stream sprinkler 20 (FIG. 4) the nozzle plate 22 has an arcuate orifice 24. Selected amounts of the orifice 24 can be blocked by inserting a plug 26 of suitable size so that the shape of coverage can be adjusted.

The principal drawback of prior rotary stream sprinklers is that they cannot accurately, uniformly and reliably deliver a predetermined very low precipitation rate over a desired shape of coverage. By way of example, a conventional rotary stream sprinkler designed to provide a ninety degree arc of coverage would require an arcuate orifice in the nozzle plate only six thousandths of an inch wide in order to achieve a flow rate of 3.6 gallons per hour at a typical water pressure of between about 20 PSI and 50 PSI. Such a tiny orifice would soon become blocked by grit and/or mineral deposits. Mover, it would be difficult to rotate the stream deflector of a conventional rotary stream sprinkler at such a low flow rate.

SUMMARY OF THE INVENTION

According to the present invention, a sprinkler nozzle includes a nozzle plate having at least one orifice formed therein. A stream deflector is rotatably mounted adjacent the nozzle plate and has a plurality of flutes formed therein that face the nozzle plate. Each flute has an inner portion that can momentarily align with water flowing through the orifice in the nozzle plate during rotation of the stream deflector relative to the nozzle plate. Water flowing through the orifice will be channeled in a generally radial direction by the flute to form a stream of water that is ejected from the stream deflector. The flutes have a plurality of different tangential trajectories relative to the orifice in the nozzle plate so that in combination the streams of water successively ejected from the stream deflector establish a predetermined shape of coverage.

BRIEF DESCRIPTION OF THE DRAWINGS

FIG. 7 illustrates a different shape of the nozzle plate than the other figures.

In FIGS. 14B, 15B and 16B the flutes on the underside of the stream deflector are illustrated in phantom lines.

DETAILED DESCRIPTION

The entire disclosures of the following U.S. patents disclosing rotary stream sprinklers, which are all assigned to Hunter Industries, Inc., the assignee of the subject application, are hereby incorporated by reference: U.S. Pat. No. 4,842,201 granted Jun. 27, 1989 to Edwin J. Hunter entitled ROTARY STREAM SPRINKLER UNIT; U.S. Pat. No. 4,867,379 granted Sep. 19, 1989 to Edwin J. Hunter entitled ROTARY STREAM SPRINKLER UNIT; U.S. Pat. No. 4,898,332 granted Feb. 6, 1990 to Edwin J. Hunter et al. entitled ADJUSTABLE ROTARY STREAM SPRINKLER; U.S. Pat. No. 4,932,590 granted Jun. 12, 1990 to Edwin J. Hunter entitled ROTARY STREAM SPRINKLER UNIT WITH ROTOR DAMPING MEANS; U.S. Pat. No. 4,967,961 granted Nov. 6, 1990 to Edwin J. Hunter entitled ROTARY STREAM SPRINKLER UNIT; U.S. Pat. No. 4,971,250 granted Nov. 20, 1990 to Edwin J. Hunter entitled ROTARY STREAM SPRINKLER WITH ROTOR DAMPING MEANS, U.S. Pat. No. 5,058,806 granted Oct. 22, 1991 to Robert L. Rupar entitled STREAM PROPELLED ROTARY POP-UP SPRINKLER WITH ADJUSTABLE SPRINKLING PATTERN; U.S. Pat. No. 5,288,022 granted Feb. 22, 1994 to George L. Sesser entitled PART CIRCLE ROTATOR WITH IMPROVED NOZZLE ASSEMBLY; U.S. Pat. No. 6,244,521 granted Jun. 12, 2001 to George Sesser entitled MICRO-STREAM ROTATOR WITH ADJUSTMENT OF THROW RADIUS AND FLOW RATE; U.S. Pat. No. 6,499,672 granted Dec. 31, 2002 to George Sesser entitled MICRO-STREAM ROTATOR WITH ADJUSTMENT OF THROW RADIUS AND FLOW RATE; U.S. Pat. No. 6,651,905 granted Nov. 25, 2003 to George Sesser et al. entitled ADJUSTABLE ARC, ADJUSTABLE FLOW RATE SPRINKLER; U.S. Pat. No. 6,688,539 granted Feb. 10, 2004 to Loren Vander Griend entitled WATER DISTRIBUTION PLATE FOR ROTATING SPRINKLERS; U.S. Pat. No. 6,736,332 granted May 18, 2004 to George L. Sesser et al. entitled ADJUSTABLE ARC, ADJUSTABLE FLOW RATE SPRINKLER; U.S. Pat. No. 7,032,836 granted Apr. 25, 2006 to George Sesser et al. entitled ADJUSTABLE ARC, ADJUSTABLE FLOW RATE SPRINKLER; and U.S. Pat. No. 7,159,795 granted Jan. 9, 2007 to George L. Sesser et al. entitled ADJUSTABLE ARC, ADJUSTABLE FLOW RATE SPRINKLER. In addition, the entire disclosure of pending U.S. patent application Ser. No. 11/762,678 of Michael L. Clark filed Jun. 13, 2007 entitled "Gear Driven Sprinkler with Top Turbine," and also assigned to Hunter Industries, Inc. is hereby incorporated by reference.

Figure 5:
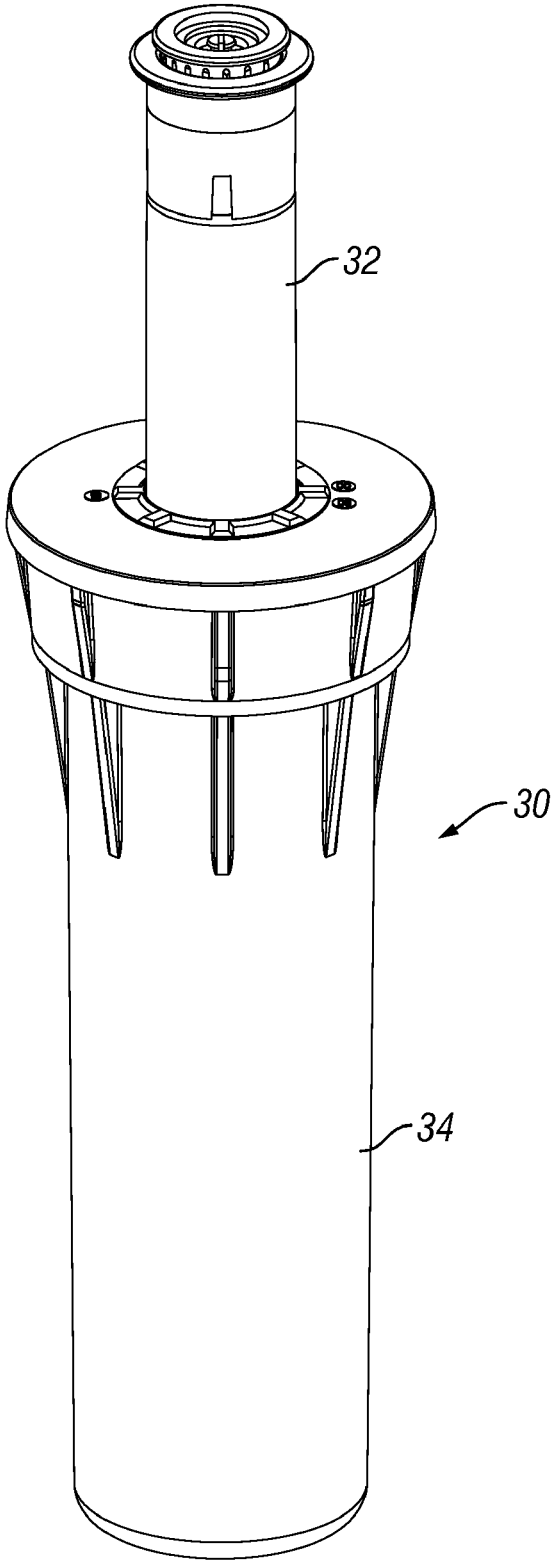
FIG. 5 is a perspective view of a pop-up rotary stream sprinkler incorporating an embodiment of the present invention with its riser extended.
Figure 6:
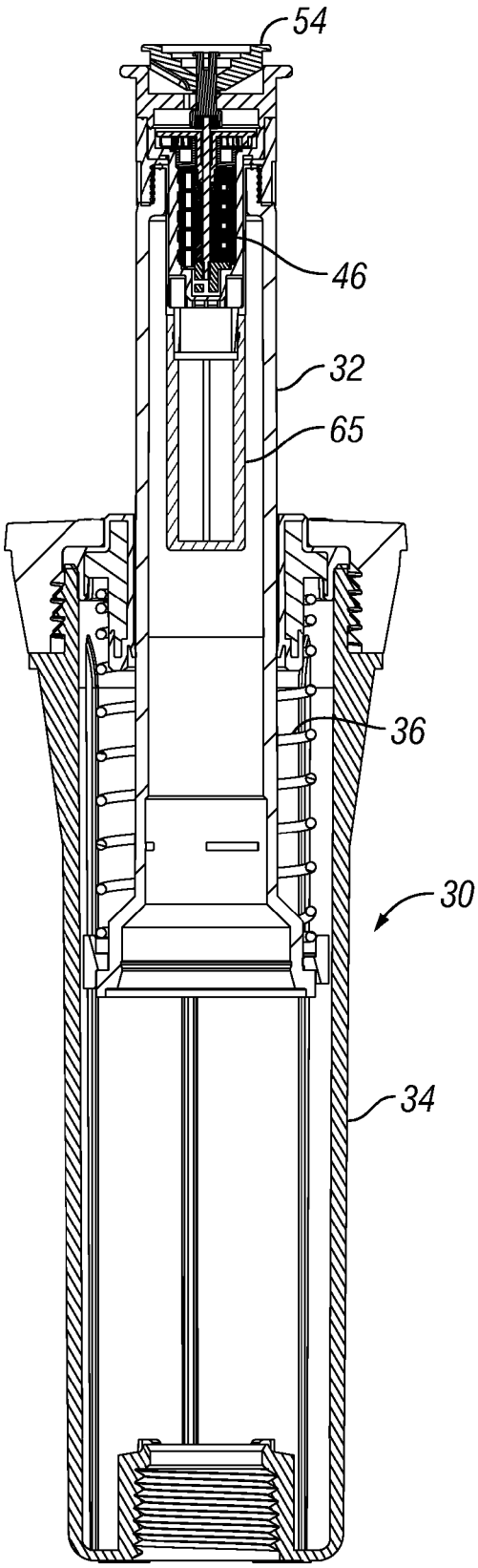
FIG. 6 is a vertical sectional view of the rotary stream sprinkler of FIG. 5 with its riser extended.
Figure 7:
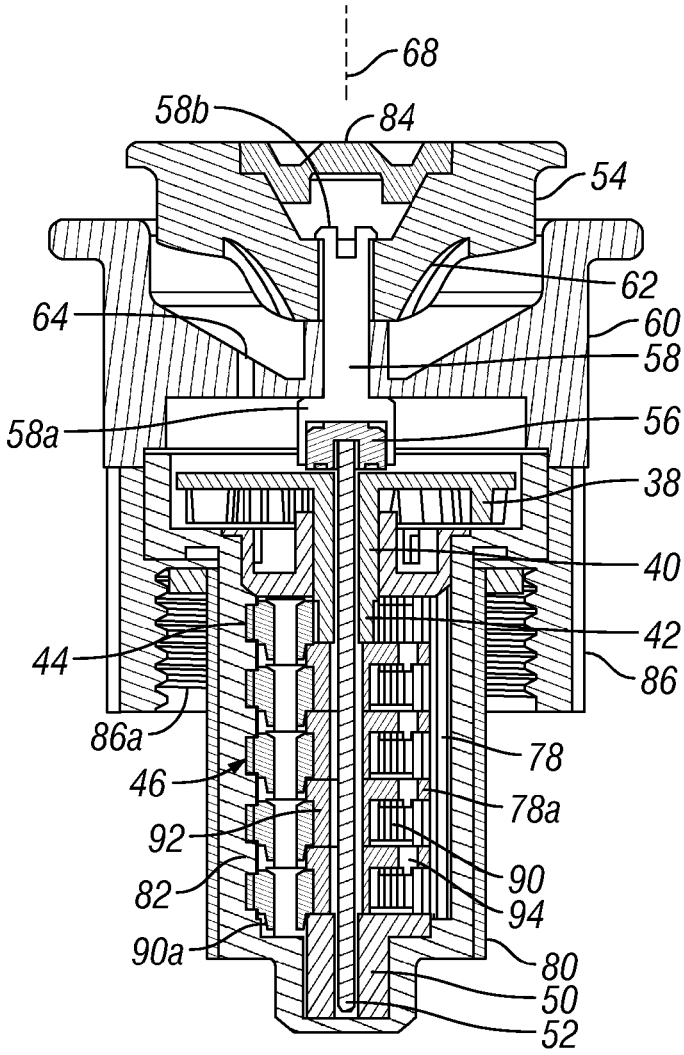
FIG. 7 is an enlarged portion of FIG. 6 illustrating details of the nozzle, turbine and planetary gear train reduction mounted in the upper portion of the riser of the rotary stream sprinkler of FIGS. 5 and 6.
Figure 8:
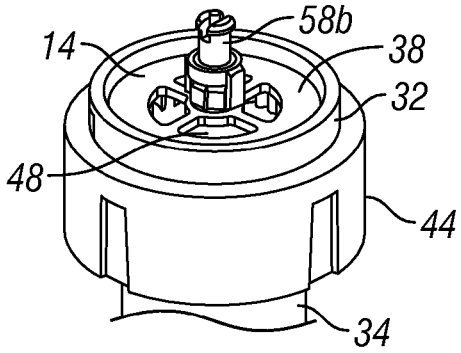
FIG. 8 is an enlarged fragmentary perspective view illustrating details of the upper end of the riser of the rotary stream sprinkler of FIG. 5.

Referring to FIG. 5, in accordance with an embodiment of the present invention, a pop-up rotary stream sprinkler 30 comprises a tubular riser 32 that telescopes within a cylindrical outer case 34 and is normally held in a retracted position by a coil spring 36 (FIG. 6). A turbine 38 (FIG. 7) is supported for high speed rotation within an upper portion of the riser 32. The turbine 38 is integrally formed with a hollow central shaft 40 having a pinion gear 42 that drives an upper input stage 44 of a planetary gear train reduction 46. Water can flow through apertures 48 (FIG. 8) in the turbine 38. The gear train reduction 46 (FIG. 7) has a lower output stage 50 that is rigidly coupled to the lower end of a drive shaft 52. The drive shaft 52 extends through the axial center of the gear train reduction 46 and loosely through turbine 38. The upper end of the drive shaft 52 is coupled to a stream deflector 54 via clutch dog 56 and clutch member 58. The clutch dog 56 is rigidly coupled to the upper end of the drive shaft 52. The clutch member 58 has a clutch cup 58*a* (FIG. 11) at its lower end with four resilient fingers that grip the clutch dog 56 but release when the stream deflector 54 is manually rotated by a vandal, for example, to prevent damage to the gear train reduction 46 by back driving the same. The upper end of the clutch member 58 is formed with a retaining head 58*b* with a tapered peripheral lip and a diametric slot so that that the stream deflector 54 can be snap fit over the retaining head 58*b* as best seen in FIG. 7. The clutch dog 56, clutch member 58 and drive shaft 52 provide a means for drivingly connecting the output stage 50 of the gear train reduction 46 and the stream deflector 54.

Figure 1:
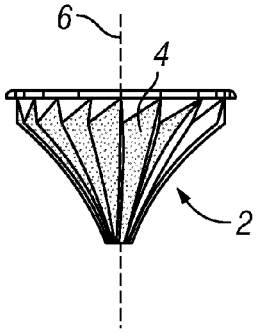
FIG. 1 (Prior Art)
FIG. 1 is a side elevation view of a stream deflector of a conventional rotary stream sprinkler.
Figure 2:
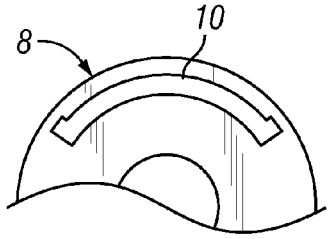
FIG. 2 (Prior Art)
FIG. 2 is a plan view of a nozzle plate of a conventional rotary stream sprinkler, the nozzle plate having an arcuate shaped orifice.
Figure 3:
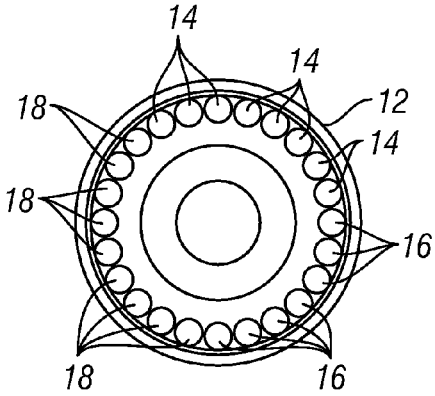
FIG. 3 (Prior Art)
FIG. 3 is a plan view a nozzle plate of another conventional rotary stream sprinkler, the nozzle plate having multiple orifices.
Figure 4:
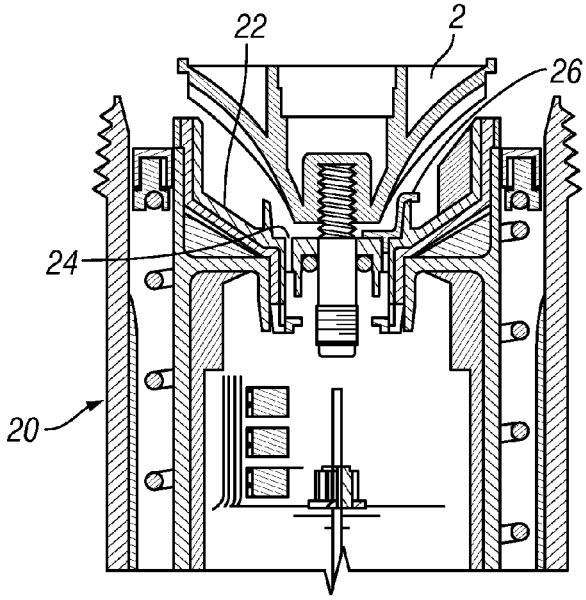
FIG. 4 (Prior Art)
FIG. 4 is a fragmentary vertical sectional view of another conventional rotary stream sprinkler having a nozzle plate with an arcuate orifice that is partially blocked by a plug to establish the shape of coverage of the sprinkler.

Referring still to FIG. 7, the turbine 38 is located at the top of the sprinkler 30 between a nozzle plate 60 and the gear train reduction 46. The location of the turbine 38 at the top of the rotary stream sprinkler 30 has particular advantages that are explained hereafter. Bearings or seals 61*a* and 61*b* (FIG. 13) surround the clutch member 58 on either side of the nozzle plate 60. While the gear train reduction 46 has the configuration of a planetary gear drive, other forms of gear train reduction could also be used such as a staggered gear train reduction of the type illustrated in FIG. 4 of pending U.S. patent application Ser. No. 11/846,480 filed Aug. 28, 2007 of Ronald H. Anuskiewicz et al., assigned to Hunter Industries, Inc., hereby incorporated by reference, for example.

Together the nozzle plate 60 and the stream deflector 54 provide a sprinkler nozzle with a unique manner of distributing water in a desired pattern which is referred to herein as a shape of coverage. Referring to FIGS. 10-13, the stream deflector 54 is generally round with an inverted frusto-conical configuration. A plurality of generally radially extending grooves, channels or flutes 62 (FIGS. 11 and 13) are formed on the underside of the stream deflector 54. The flutes 62 are upwardly inclined and are capable ejecting successive streams of water that extend at different lateral angles. The flutes 62 are vertically inclined relative to a horizontal plane orthogonally intersecting the vertical rotational axis 68 (FIG. 7) of the stream deflector 54. The angle of vertical inclination of the flutes 62 can be varied to produce the desired shape of coverage and/or to change the radius or reach of the streams of water ejected by the stream deflector 54.

The nozzle plate 60 is generally cylindrical and has a round orifice 64 (FIGS. 7 and 13) formed therein. The size of the orifice 64 may be 0.028 inches in diameter, so that the rotary stream sprinkler 30 has a very low rate of precipitation, e.g. 3.6 gallons per hour, when the sprinkler 30 is coupled to a source of water pressurized between about 20 and 50 PSI. However, the size of the orifice 64 is large enough to resist clogging via grit and mineral deposits. The rotary stream sprinkler 30 includes a screen 65 (FIG. 6) to filter out debris and help reduce clogging of the orifice 64 in the nozzle plate 60.

Figure 13:
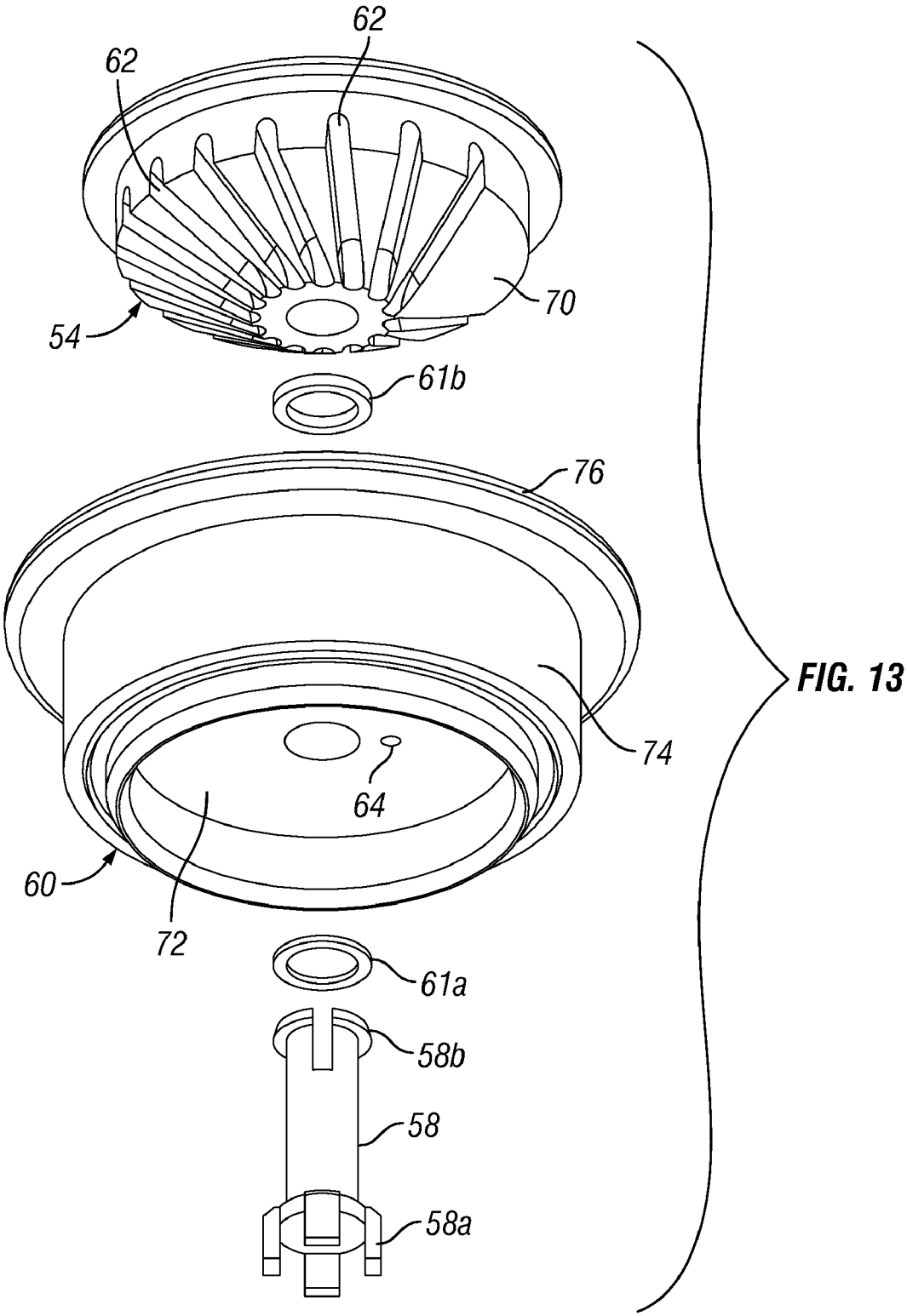
FIG. 13 is a slightly reduced exploded perspective view of the nozzle plate and stream deflector of FIG. 10 taken from the bottom side of FIG. 10.
Figure 14A:
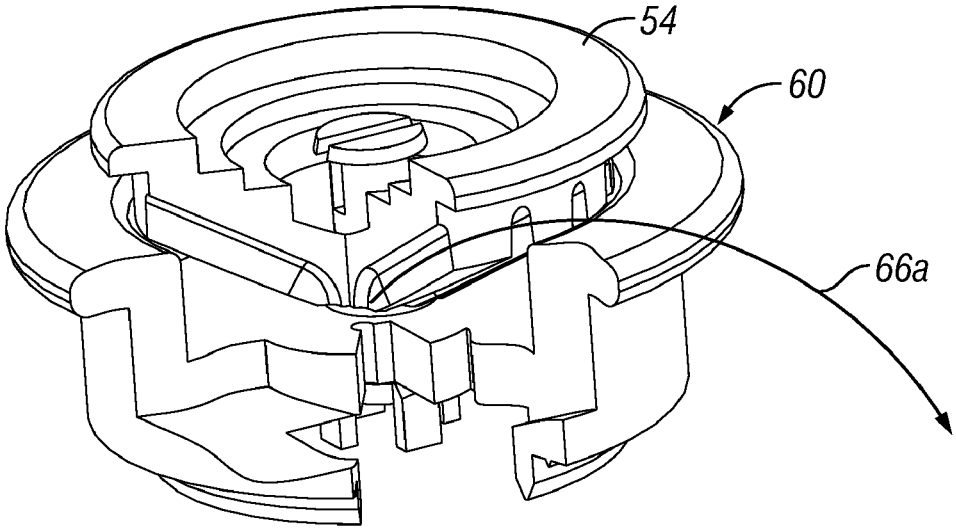
FIGS. 14A, 14B, 15A, 15B, 16A and 16B are a series of fragmentary perspective (the A figures) and fragmentary top plan views (the B figures), illustrating the manner in which the nozzle plate and stream deflector of FIG. 10 successively eject streams of water at different angles that when added together establish a predetermined shape of coverage.

The stream deflector 54 is rotatably mounted adjacent the nozzle plate 60 so that the plurality of flutes 62 face the nozzle plate 60. Each flute 62 opens downwardly and has an inner portion 62*a* (FIG. 11) that momentarily aligns with the orifice 64 in the nozzle plate 60 during rotation of the stream deflector 54 relative to the nozzle plate 60. All that is necessary is that the inner portion 62*a* of each flute 62 momentarily align with the stream of water ejected from the orifice 64 in the nozzle plate 60. During this momentary alignment, water flowing through the orifice 64 will be channeled in a generally radial direction by the flute 62 to form a stream of water 66*a* (FIGS. 14A and 14B) that is ejected from the stream deflector 54, usually onto adjacent vegetation such as turf or shrubs. The rotary stream sprinkler 30 can also be employed in connection with watering artificial turn where water is applied for cooling or to disperse a germicide. As best seen in FIG. 13, the flutes 62 have a plurality of different lateral trajectories (viewed from above) relative to the orifice 64 in the nozzle plate 60 so that in combination the sum of the streams of water 66 that are successively ejected from the stream deflector 54 establish a predetermined shape of coverage.

Figure 11:
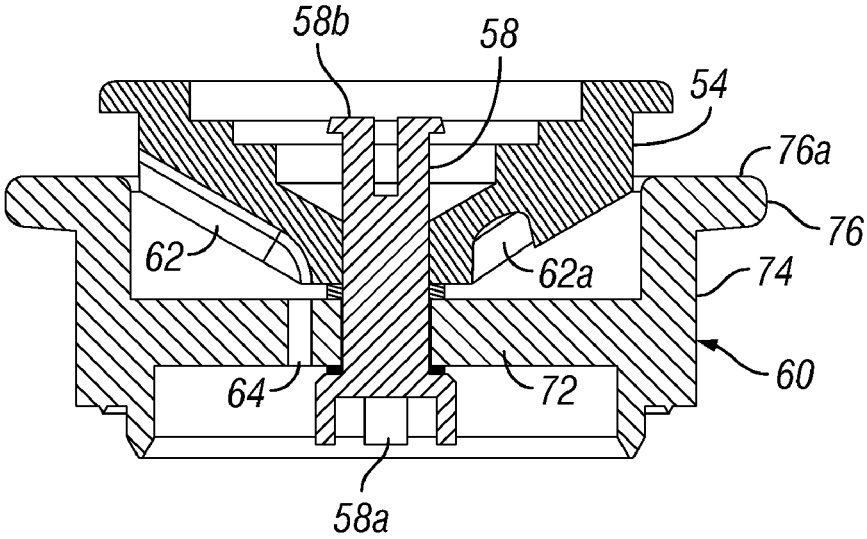
FIG. 11 is a vertical sectional view of the nozzle plate and stream deflector taken along line 11-11 of FIG. 10.
Figure 12:
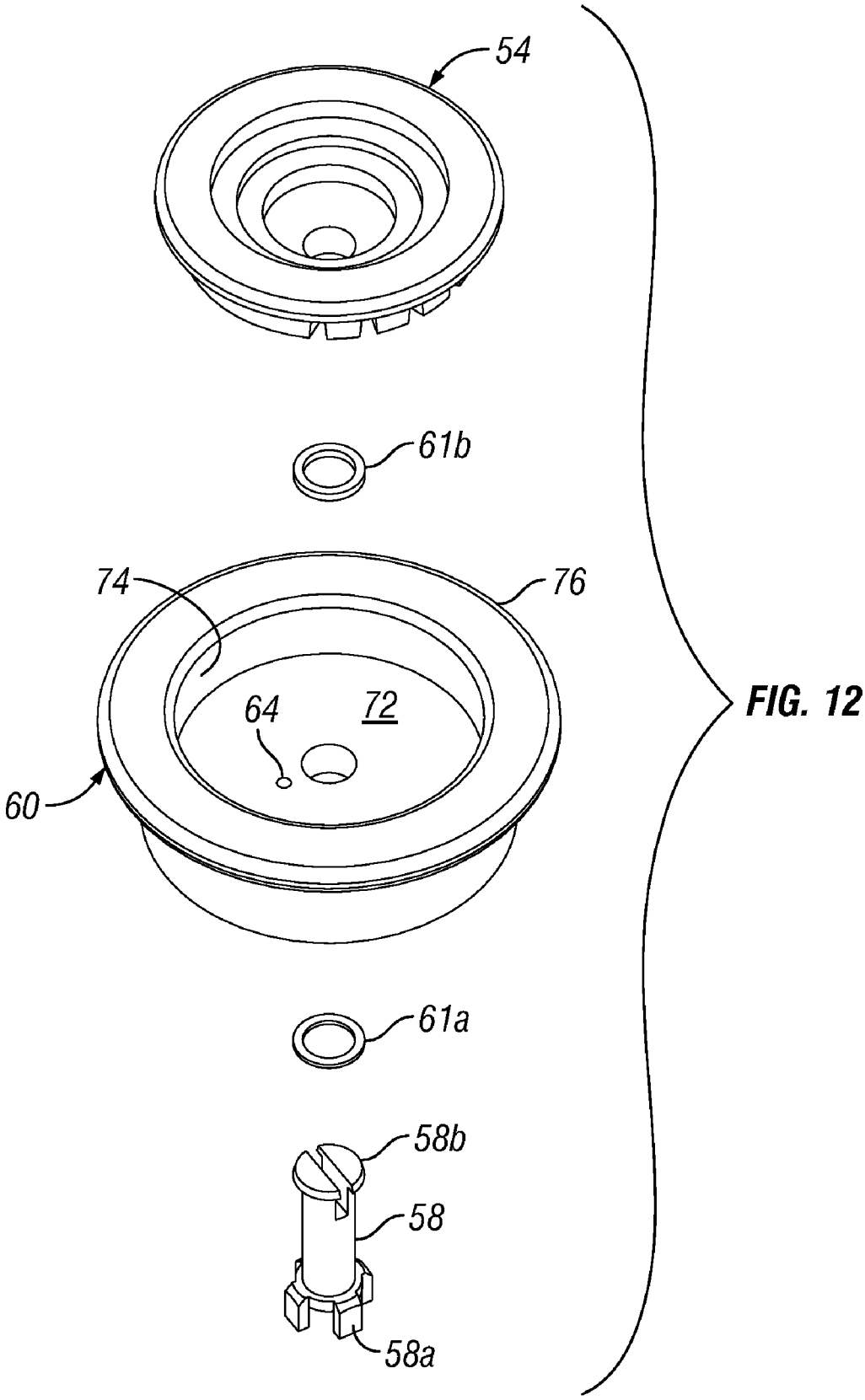
FIG. 12 is a slightly reduced exploded perspective view of the nozzle plate and stream deflector of FIG. 10 taken from the top side of FIG. 10.
Figure 14B:
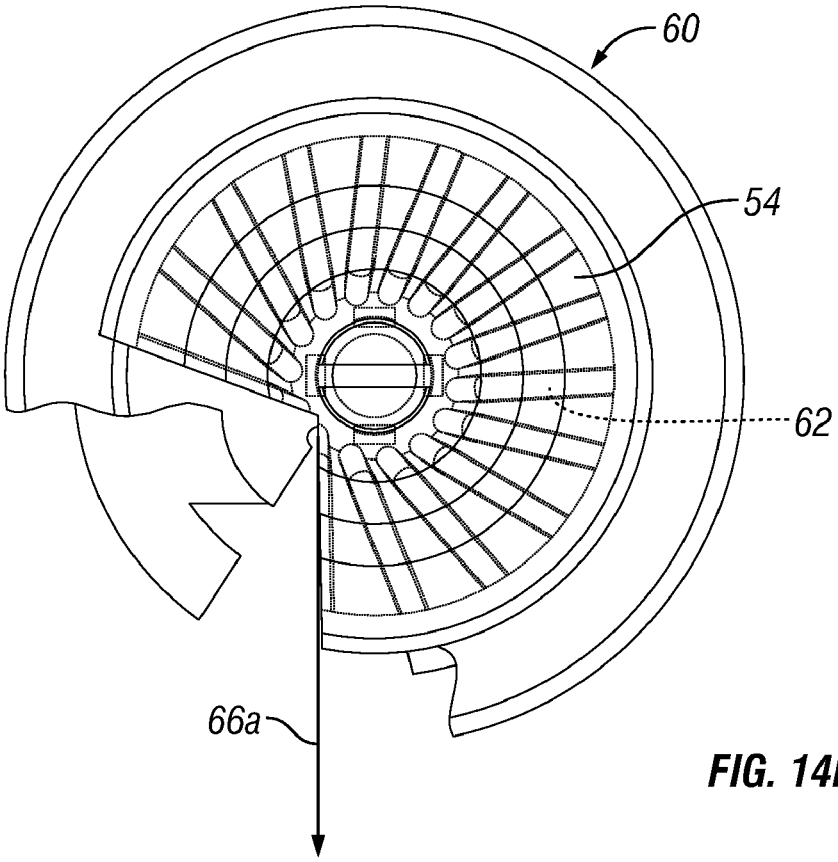
Figure 15A:
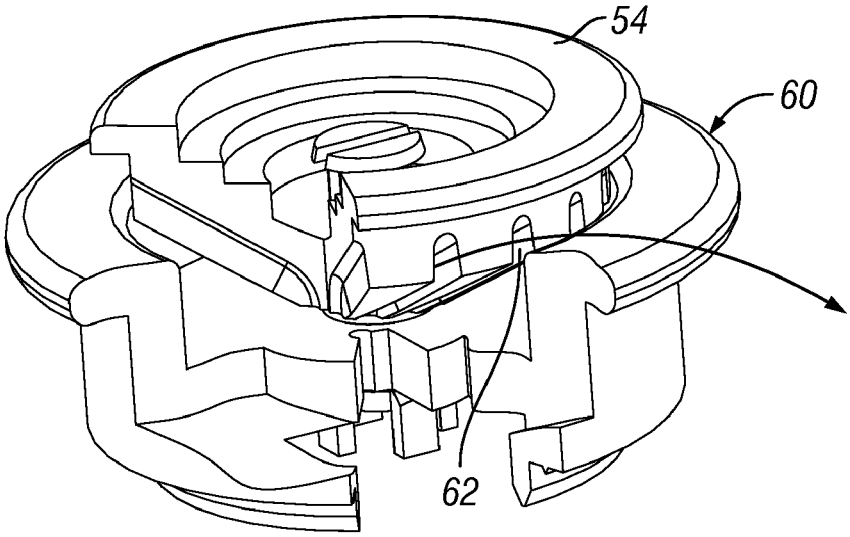
Figure 15B:
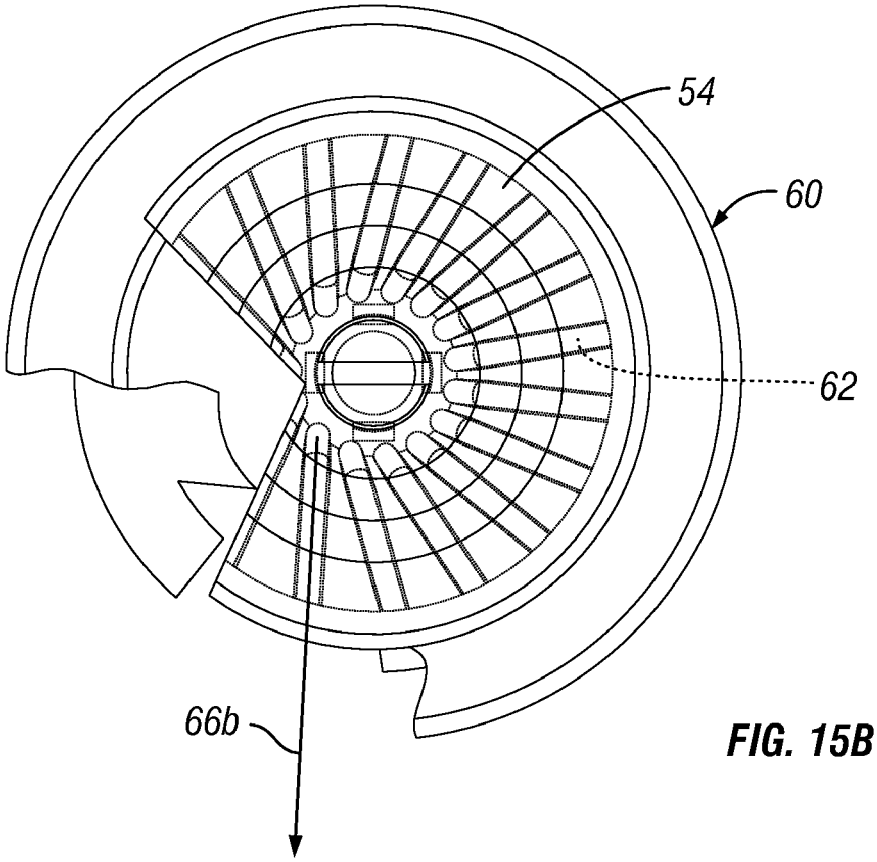
Figure 16A:
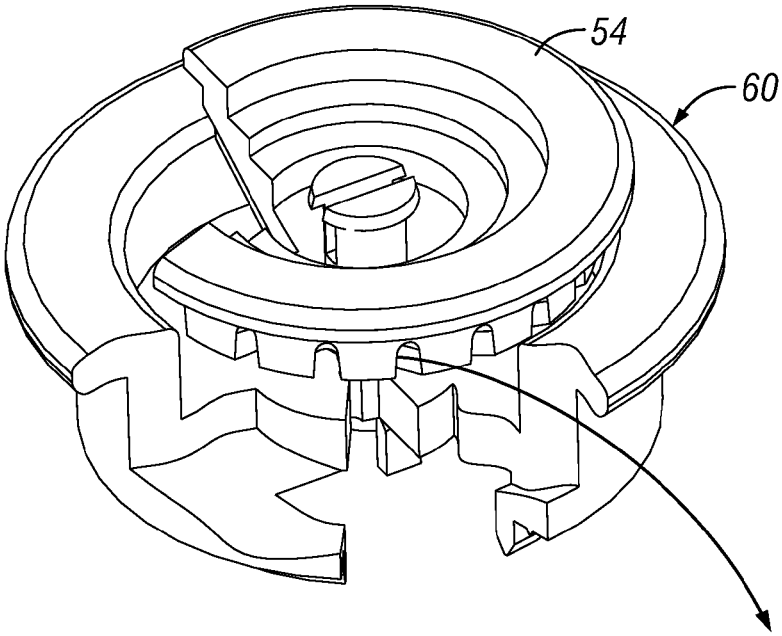
Figure 16B:
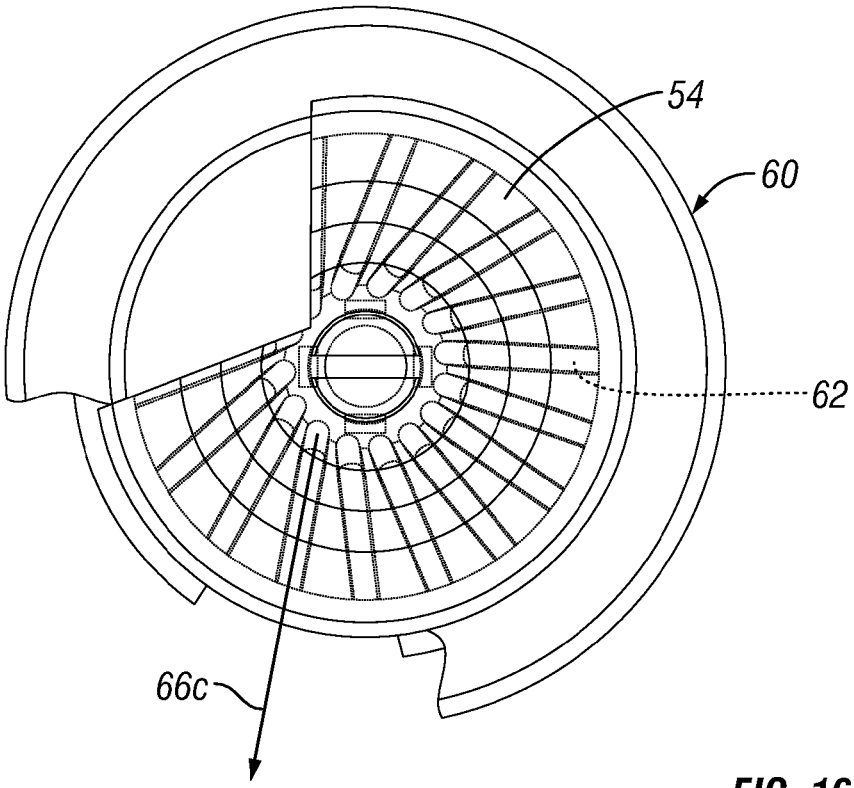

The flutes 62 are formed so that successive streams of water 66*a* (FIGS. 14A and 14B), 66*b* (FIGS. 15A and 15B), and 66*c* (FIGS. 16A and 16B) extend at different lateral angles as the stream deflector 54 continuously rotates at a relatively slow speed, e.g. preferably less than one RPM. The trajectories of the successive streams of water progress so that eventually water has been supplied over all of the desired shape of coverage. The flutes 62 have a generally hemispherical cross-section as illustrated in FIGS. 11 and 13. The flutes 62 are generally straight and the axis of each flute does not intersect the vertical rotational axis 68 (FIG. 7) of the stream deflector 54. The flutes 62 could have other cross-sectional shapes besides hemispherical, including V-shaped, rectangular, oval, and so forth. As illustrated in FIG. 13, the flutes 62 extend in a tangential fashion relative to the rotational center of the stream deflector 54. The orifice 64 in the nozzle plate 60 is radially offset from the rotational axis 68 of the stream deflector 54. Each flute 62 is angled relative to the orifice 64, instead of the rotational axis 68. A portion 70 of the underside of the stream deflector 54 has a generally smooth surface and extends between the flutes 62. Viewed from the top of the stream deflector 54 as shown in FIG. 14B, it can be seen that in the embodiment illustrated, the angle between adjacent flutes 62 progressively increases as the flutes 62 get nearer to the smooth portion 70. The number, angle and placement of the flutes 62, together with the size of the smooth portion 70 determines the size of the shape of coverage of the rotary stream sprinkler 30, e.g. ninety degrees, one hundred and eighty degrees, and so forth. The size of the shape of coverage produced by the nozzle comprising the rotating novel stream deflector 54 and the nozzle plate 60 is independent of the size, shape, location and/or number of orifices in the nozzle plate 60 in contrast to conventional rotary stream sprinklers. The shape of coverage produced by the stream deflector 54 and the nozzle plate 60 is solely determined by the trajectory of the flutes 62 formed in the underside of the stream deflector 54.

Each flute 62 contributes to watering a specific portion of the desired shape of coverage. Only a single stream of water is ejected at any one time. This is to be contrasted with conventional rotary stream sprinklers that utilize a combination of broken and unbroken streams that are ejected simultaneously to fill in the shape of coverage. As each flute 62 comes into alignment with the stream of water ejected from the orifice 64 and goes out of alignment with the stream of water ejected from the orifice 64, the stream will effectively be turned On and OFF and water in the stream will gradually reach all the way out to the maximum radius and then all the way in, watering a sector along a radius that extends from the rotary stream sprinkler 30. In addition the vertical inclination of the flutes 62 can be varied so that the streams of water 66*a*, etc. will cover areas closer in or farther out from the rotary stream sprinkler 30. Also stream interrupters (not shown) can be employed to ensure that regions close to the rotary stream sprinkler 30 will receive adequate water.

The orifice 64 may be circular, or it may have another shape. The orifice 64 can be sized so that less than about eight gallons of water per hour will be ejected onto a predetermined shape of coverage at a pressure of between about 20 PSI and 50 PSI. Based on information and belief, this is less than the minimum precipitation rate of any conventional rotary stream sprinkler that has heretofore been commercialized. A preferred embodiment of the rotary sprinkler 30 delivers approximately 3.6 gallons of water per hour over a ninety degree arc of coverage using a round nozzle orifice 64 having a diameter of 0.028 inches.

The nozzle plate 60 has a central disk portion 72 (FIG. 11) with the orifice 64 formed therein, and a surrounding cylindrical collar 74 that terminates in an annular lip 76. The upper edge 76*a* has a curved inner shoulder and terminates just below the distal portions of the flutes 62 so that the streams of water ejected from the flutes 62 at an upward angle clear the nozzle plate 60. The term "nozzle plate" refers to any structure having a least one orifice for directing water onto the stream deflector and it need not be flat or have the stepped cylindrical configuration illustrated in FIGS. 11 and 12. The nozzle plate could have a configuration similar to one of those disclosed in the U.S. patents listed above that are incorporated herein by reference.

Figure 9:
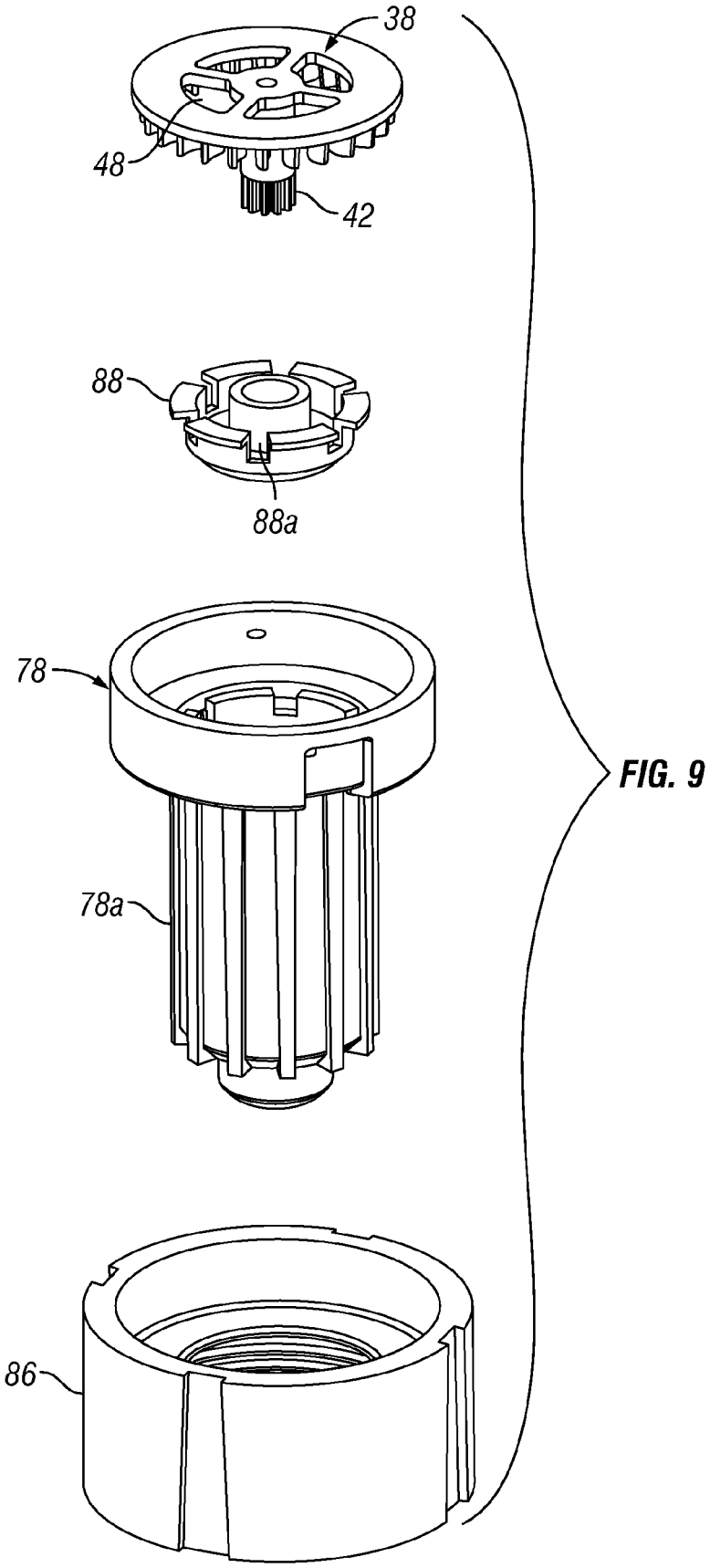
FIG. 9 is an exploded perspective view of the nozzle base, gear box, by-pass flow member and turbine of the rotary stream sprinkler of FIGS. 5 and 6.
Figure 10:
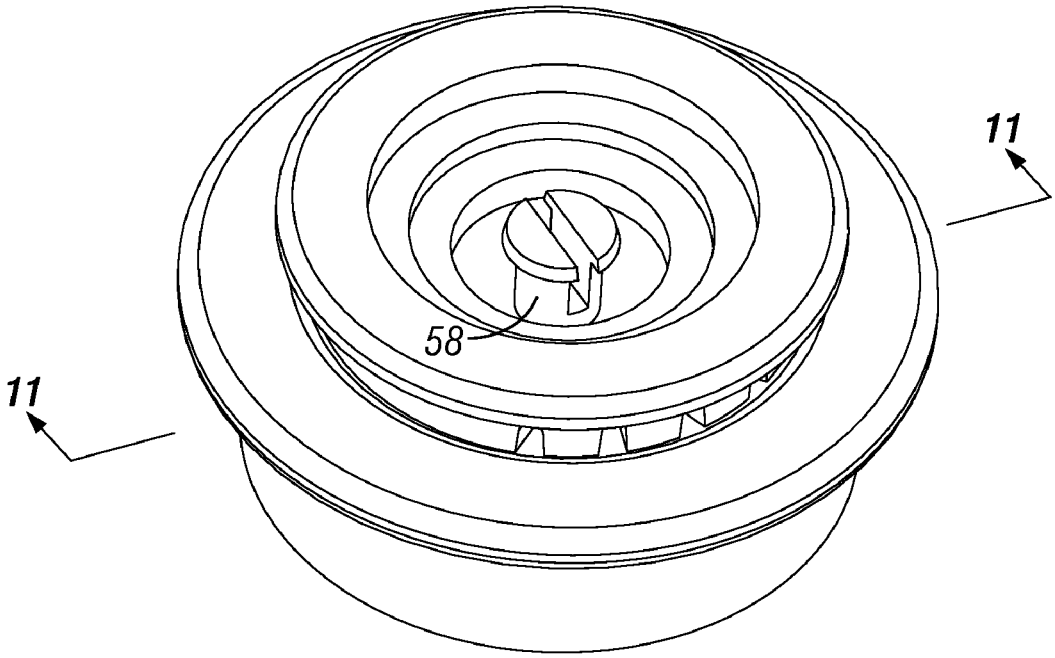
FIG. 10 is an enlarged perspective view of the nozzle plate and stream deflector of the rotary stream sprinkler of FIG. 5 taken from the top of FIG. 5.

The gear drive train reduction 46 is enclosed in a gear box 78 (FIGS. 7 and 9) having a ring gear 78*a* formed on an interior surface of a lower portion thereof. A cylindrical housing 80 (FIG. 7) surrounds and supports the gear box 78 and defines a primary flow path 82 leading to the turbine 38. A screen retainer (not illustrated in FIG. 7) snap fits into the lower end of the housing 80 and removably receives the screen 65 (FIG. 6) that filters dirt and other debris. A cap 84 snap fits into the top side of the stream deflector 54.

A cylindrical nozzle base 86 (FIG. 7) surrounds the turbine 38 and the gear train reduction 46. The nozzle base 86 has a female threaded segment 86*a* for screwing over the male threaded upper segment of the riser 32 (FIG. 6). The nozzle base 86 could also be screwed over the male threaded upper segment of a fixed riser in which case the sprinkler would not be in a pop-up configuration. The nozzle base 86 could instead have a male threaded segment for screwing over a female threaded upper segment of a fixed riser.

The rotary stream sprinkler 30 has a secondary flow path that includes small radial channels 88*a* (FIG. 9) in a by-pass flow member 88. The size, number, shape and/or arrangement of the channels 88*a* can be changed to adjust the flow rate to the turbine 38. The gear train reduction 46 includes planet gears 90 (FIG. 7) and sun gears 92. Each sun gear 92 is integrally formed in the center of a circular carrier 94. The planet gears 90 have posts 90*a* that extend downwardly from the same and rotate in round holes formed in the corresponding circular carrier 94. The planet gears 90 engage the ring gear 78*a* formed on the interior of the lower segment of the gear box 78 and also engage the corresponding sun gear 92. Preferably the planetary gear train reduction 46 reduces the RPM of the turbine 38, which is typically several hundred, down to less than one RPM.

The novel combination of the stream deflector 54, nozzle plate 60, gear train reduction 46 and nozzle base 86 is modular in the sense that this assembly can be manufactured with varying water distribution patterns and/or flow rates and can be conveniently screwed into the top of a fixed riser instead of a conventional spray head. This assembly can also be screwed into the riser of a pop-up spray-type sprinkler. Locating the turbine 38 above the gear train reduction 46 eliminates the pressure difference that otherwise tends to cause dirt and other debris to enter the gear box 78. The top placement of the turbine 38 reduces adverse effects of water and air surges that can damage a turbine located at the lower end of a sprinkler. Locating the turbine 38 at the top of the rotary stream sprinkler 30 also allows the turbine 38 to have a larger diameter which produces a larger drive force for the stream deflector 54. The additional water flow needed for large radius or arc of coverage does not have to flow around the turbine 38, thereby providing increased torque.

While I have described and illustrated an embodiment of a pop-up sprinkler with an improved rotary stream nozzle in detail, it should be apparent to those skilled in the art that my invention can be modified in arrangement and detail. For example, there may be a stator or bias opening above the turbine 38 for flow requirements from a larger nozzle, increased arc or increased radius. The rotary stream sprinkler 30 may have a fixed arc or an adjustable arc or it can be designed to provide a shape of coverage that is a full circle. The shape of coverage can also take other shapes, such as semi-circular, square, rectangular, oval, thin strip, or any other shape employed in commercial and residential irrigation. Other components may be included to control the radius. The rotary stream sprinkler 30 may include an alternate nozzle plate that has multiple orifices so that the nozzle simultaneously ejects multiple streams of water. Therefore, the protection afforded my invention should only be limited in accordance with the following claims.

I claim:

1. A sprinkler, comprising:

a nozzle plate having at least one orifice formed therein; and a steam deflector rotatably mounted adjacent the nozzle plate and having a plurality of flutes formed therein in a side thereof facing the nozzle plate, the side of the stream deflector having the flutes being formed with a generally smooth surface that extends between the flutes with a first angular dimension larger than a largest second angular dimension between adjacent flutes, wherein each single flute having an inner portion that momentarily aligns with water flowing through the orifice in the nozzle plate during rotation of the stream deflector relative to the nozzle plate wherein water flowing through the orifice will be channeled in a radial direction by each single flute thereby forming a stream of water that is ejected from the stream deflector and further wherein the flutes extend at progressively increasing angles wherein a combination of streams of water successively ejected from the stream deflector establish a predetermined shape of coverage having a size determined by the first angular dimension of the smooth surface that extends between the flutes.

2. The sprinkler of claim 1 and further comprising a nozzle base that supports the nozzle plate.

3. The sprinkler of claim 1 wherein the flutes have a generally hemispherical cross-section.

4. The sprinkler of claim 1 wherein the flutes are generally straight and an axis of at least some of the flutes does not intersect a rotational axis of the stream deflector.

5. The sprinkler of claim 1 wherein the orifice is radially offset from a rotational axis of the stream deflector.

6. The sprinkler of claim 5 wherein the orifice in the nozzle plate is a single aperture offset from a center of the nozzle plate.

7. The sprinkler of claim 1 wherein at least some of the flutes extend in a tangential fashion relative to a rotational center of the stream deflector.

8. The sprinkler of claim 1 and further comprising a turbine operatively coupled to the stream deflector.

9. The sprinkler of claim 8 wherein the turbine is operatively coupled to the stream deflector through a gear train reduction.

10. A sprinkler, comprising:

a turbine;

a gear train reduction coupled to the turbine;

a nozzle plate mounted above the turbine and having at least one orifice formed therein; and a stream deflector coupled to the gear train reduction and mounted above the nozzle plate, the stream deflector having a plurality of flutes formed therein on an underside of the stream deflector facing the nozzle plate, each single flute having an inner portion that can momentarily aligns with water flowing through the orifice in the nozzle plate during rotation of the stream deflector relative to the nozzle plate and wherein water flowing through the orifice will be channeled in a radial direction by each single flute forming streams of water successively ejected from the stream deflector thereby establishing a predetermined arc of coverage determined by a size of a region of the underside of the stream deflector without said stream forming flutes.

11. The sprinkler of claim 10 wherein the orifice is sized so that less than about eight gallons of water per hour will be ejected on a predetermined shape of coverage at a pressure of between about 20 PSI and 50 PSI.

12. The sprinkler of claim 10 wherein a single stream of water is ejected from the stream deflector when one of the plurality of flutes is aligned with water flowing through the orifice.

13. The sprinkler of claim 10 wherein the flutes of the stream deflector have different angles of inclination to vary a range of the streams of water ejected by the flutes.

14. The sprinkler of claim 10 wherein the turbine is mounted between the gear train reduction and the stream deflector.

* * * * *